US008020702B2

(12) United States Patent
Strub et al.

(10) Patent No.: US 8,020,702 B2
(45) Date of Patent: Sep. 20, 2011

(54) PACKAGING FOR MEDICAL PRODUCTS AND THE LIKE

(75) Inventors: Nikolai Strub, Kaltenkirchen (DE); Gottfried Von Bismarck, Hamburg (DE); Gerhard Breu, Güttingen (CH)

(73) Assignee: AvidiaMed GmbH, Hamburg (DE)

( * ) Notice: Subject to any disclaimer, the term of this patent is extended or adjusted under 35 U.S.C. 154(b) by 322 days.

(21) Appl. No.: 12/158,581

(22) PCT Filed: Dec. 21, 2006

(86) PCT No.: PCT/EP2006/012644

§ 371 (c)(1), (2), (4) Date: Jun. 20, 2008

(87) PCT Pub. No.: WO2007/077034

PCT Pub. Date: Jul. 12, 2007

(65) Prior Publication Data

US 2009/0188828 A1 Jul. 30, 2009

(30) Foreign Application Priority Data

Dec. 21, 2005 (EP) ..... 05090355

(51) Int. Cl.

*B65D 83/04* (2006.01)
*B65B 1/04* (2006.01)
*B65B 7/28* (2006.01)

(52) U.S. Cl. ..... 206/531; 206/534; 206/539; 53/467; 53/473; 53/281; 53/287

(58) Field of Classification Search ..... 206/528, 206/530–534, 538, 539, 459.1, 459.5; 53/443, 53/451, 452, 467, 473, 476, 478, 266.1, 281, 53/285, 287

See application file for complete search history.

(56) References Cited

U.S. PATENT DOCUMENTS 3,381,808 A * 5/1968 McGraw, II ..... 206/534
3,397,671 A * 8/1968 Hartman, Jr. et al. ..... 206/532
3,732,544 A 5/1973 Obland (Continued)

FOREIGN PATENT DOCUMENTS

DE 197 13 685 A1 11/1997

(Continued)

OTHER PUBLICATIONS

International Search Report for PCT/EP2006/012644 mailed Mar. 27, 2007.

(Continued)

*Primary Examiner* — Luan K Bui

(74) *Attorney, Agent, or Firm* — Venable LLP; Robert Kinberg; Leigh D. Thelen

(57) ABSTRACT

The invention relates to a pack for pharmaceutical and/or medical products and/or food supplements, comprising a substrate which is fitted with one or more prefabricated, sealed product carriers which each contain one or more isolated products, for a given length of time, and is provided with instructions for application or administration time for the patient, wherein each product carrier exclusively contains products of a special active ingredient or a special combination of active ingredients in a special dosage, which is distinguished by the fact that each product carrier forms part of a single-strip blister pack that can be rolled up, and the product carriers each containing one or more isolated products are assembled on the substrate individually to the patient. Furthermore the invention concerns a method as well as an apparatus for the manufacture of such packs.

25 Claims, 7 Drawing Sheets

U.S. PATENT DOCUMENTS

| | | | | | |
|---|---|---|---|---|---|
| 4,254,871 | A | * | 3/1981 | Poore | 206/534 |
| 4,617,557 | A | * | 10/1986 | Gordon | 206/534 |
| 4,736,849 | A | * | 4/1988 | Leonard et al. | 206/534 |
| 4,955,481 | A | * | 9/1990 | Novinski et al. | 206/534 |
| 4,958,736 | A | * | 9/1990 | Urheim | 206/531 |
| 5,050,739 | A | | 9/1991 | Hannan et al. | |
| 6,681,935 | B1 | | 1/2004 | Lewis | |
| 2004/0026293 | A1 | | 2/2004 | Hughes | |
| 2004/0148054 | A1 | | 7/2004 | Schwartz | |

FOREIGN PATENT DOCUMENTS

| | | | |
|---|---|---|---|
| EP | 0 852 208 | A1 | 7/1998 |
| EP | 1 481 913 | A1 | 12/2004 |
| GB | 2 295 820 | A | 6/1996 |

OTHER PUBLICATIONS

PCT/ISA/210 and translation.
PCT/ISA/237 and translation.

* cited by examiner

PACKAGING FOR MEDICAL PRODUCTS AND THE LIKE

CROSS-REFERENCE TO RELATED APPLICATIONS

This application is a National Stage Application of PCT/EP2006/012644, filed Dec. 21, 2006, which designates the United States and claims the priority of European Patent Application No. 05090355.8, filed on Dec. 21, 2005.

BACKGROUND OF THE INVENTION

The invention relates to a pack for pharmaceutical and/or medical products and/or food supplements, comprising a substrate which is fitted with one or more prefabricated, sealed product carriers which each contain one or more isolated products, for a given length of time, and is provided with instructions for application or administration time for the patient, each product carrier exclusively containing products of a special active ingredient or a special combination of active ingredients in a special dosage. Furthermore, the invention relates to a method and an apparatus for the manufacture of these packs.

For the primary packings of pharmaceutical and/or medical products and/or food supplements (which are hereinafter also referred to as products), for example one might mention tablets, dragées, ampoules, vitamin preparations but also syringes or the like, different requirements are important. On the one hand there are constant endeavours to make it easier for patients to take the drugs or apply the products. In addition to easier removal of the product from the pack by corresponding removal aids, the packs existing for this purpose also assist the patients with the dosage and when to take the drugs. These aspects are usually known under the keywords "convenience" or "senior-friendliness" (SF). On the other hand the aspect concerning child safety, so-called child resistance (CR), is of increasing importance under regulations. The common packs are therefore protected by various measures against unauthorised removal in particular by children.

It is, however, precisely in the case of pharmaceutical and/or medical products that the reliability of keeping the prescribed drugs is of particular importance, which is to be assisted by the so-called compliance packs. It has been shown that patients take the drugs prescribed for them more reliably if one or more and/or various drugs are arranged adjacent to each other or together within one pack and the necessary times of application or taking are described by calendar and time data. For instance, gastric protection preparations are to be taken simultaneously in addition to antibiotics. Arranging or assembling the drugs according to day of the week and time of day makes it easier for the patient to take his prescribed drugs reliably, which is of particular importance in particular for chronically ill patients.

Packs which ensure assembly of one or more products individually to the patient are known and available on the market. Thereby, the products are either put directly as raw materials or, after removal from a package, into the corresponding packs individual to the patient, e.g. in compartments of packaging units. However, this presupposes firstly that this must be done under defined clean-room conditions and with pharmaceutical experts, which leads to very high costs. Secondly, partly manual removal and repackaging is susceptible to error, laborious and expensive due to the large number of steps to be taken, and furthermore also leads to mechanical stress on the products. Moreover, the packaging of drugs from raw materials and the handling of raw materials after removal from the package require special basic legal conditions which take considerable effort to fulfil. With the known packs made by the methods described above, under certain circumstances several different products/tablets are arranged in a holding chamber, e.g. a bag, a tubular bag, a nest of a blister pack or the like. However, this is disadvantageous in particular due to the risk of cross-contamination. To avoid such cross-contamination there are endeavours to place the products each individually in the closed state on a pack. This means that the products are arranged separately in a compartment of a packaging unit or a nest of the blister pack and, packed in this way, are to be assembled into a pack intended for the patient.

From EP 0 852 208 A1 a tablet container is also known having the features of the preamble of claim 1. This pack has a substrate on which several isolated products are arranged in sealed product carriers, wherein the dosage of the same active ingredient or the same combination of active ingredients for the treatment of Parkinson's disease increases gradually (first day one tablet, second day one tablet, third day two tablets, fourth day three tablets, etc.). The products are prefabricated in sheet-like blisters. Such blisters thereby have several columns and several rows, for example as 2×5 blisters. This means that the products are each located individually in sealed nests of the blister tray/blister magazine. Sealed in this context means that each product within the nest is surrounded on all sides in relation to the environment, so that the products are protected from external influences (mechanical stress or other contamination, in particular biological or chemical contamination). Product carriers separated off from the blister tray/blister magazine can in this case contain one or more isolated products. These product carriers are then assembled into a treatment-specific pack. Besides the disadvantage of purely treatment-specific assembly of the products just discussed, automated production of such a pack is possible only with unreasonable effort because e.g. separation of individual product vehicles from a flat, multi-row blister tray must be carried out in different directions. To sum up, the pack described in the above European patent document is assembled exclusively for a specific treatment and can be manufactured automatically only uneconomically.

SUMMARY OF THE INVENTION

It is therefore the object of the present invention to provide a safe and cheap pack which is individual to the patient. Furthermore it is the object of the invention to propose a corresponding method and an apparatus for manufacture of the pack.

The object is achieved firstly by a pack having the features mentioned hereinbefore, by the fact that each product carrier forms part of a single-strip blister pack that can be rolled up, and the product carriers each containing one or more isolated products are assembled on the substrate individually to the patient. Thus, in a particularly simple and cheap manner a pack individual to the patient is provided, as single or multiple products of the most varied kinds can be allocated in a freely selectable quantity to the pack or to the substrate. In other words, the pack allows times of day for taking the drugs that can be freely chosen for each patient. A crucial advantage lies in that the products are protected from actual manufacture until opening/removal by the patient, as the products themselves are located in the sealed product carriers during and after assembly of the pack which is individual to the patient, and therefore not exposed to either mechanical and/or other influences of the environment, nor is cross-contamination to be feared. The problems with handling raw materials can therefore be avoided with this pack and sterile assembly can be guaranteed in a simple manner. However, this also means that the most varied products can also be combined by different manufacturers or by a third party. Due to the fact that each product carrier forms part of a single-strip blister pack that can be rolled up, the pack can be manufactured automatically by simple means, which affords a considerable economic advantage even in the case of individual packs (no pack need be the same as another) and due to the number of packs produced.

Preferably, the substrate carries or forms a blister composite, such that several sections of the product-specific blister strip packs each with different products from one or more manufacturers are applied to the substrate. Due to the pack according to the invention, a pack which in a particularly simple manner combines packaged products of several manufacturers and presents them in a manner individual to the patient is provided for the first time ever.

Advantageously, in each nest of each blister strip pack or of each section of the blister strip packs is arranged precisely one product. As a result, in addition to avoiding cross-contamination, the products can also be prevented from rubbing against each other. Each product is protected optimally and maximally.

In a preferred development of the invention, the pack is manufactured fully automatically. This guarantees assembly of the products into a pack with few mistakes, so that incorrect medications are avoided. Automatic manufacture also ensures the necessary economic efficiency of the pack.

Secondly, the object is achieved by a method for the manufacture of a pack for pharmaceutical and/or medical products and/or food supplements by the following steps: preparing a substrate, selecting patient-individual products for a given period of time, separating prefabricated, sealed product carriers with the selected patient-individual products from single-strip blister packs that can be rolled up, whereby each product carrier carries only one or more products of a special active ingredient or special combination of active ingredients in a special dosage, and automatically positions and fixes the separated product carriers on the substrate as prescribed individually for the patient. Due to this method it is possible in a particularly simple manner to manufacture patient-individual packs economically, as the individual products can be separated from the blister strip pack in the desired quantity without unpacking and repacking, and assembled to form a blister composite. Due to the fact that the products are at all times protected, that is, from manufacture to removal by the patient are located in the nest of the blister strip pack, assembly of the products into a patient-specific pack can also be done by third parties who are not manufacturers of pharmaceutical products/drugs. As a result there is an increase in flexibility in manufacture of the final pack. Due to preparation of the products on blister strips that can be rolled up and that are particularly easy to run on machines, particularly easy assembly of different products even from different manufacturers on an apparatus for manufacture of the pack is ensured.

Advantageously, the pack is manufactured automatically, as a result of which mistakes in selection and assembly of the products can be reduced.

The object is also achieved by an apparatus which is distinguished by the fact that it includes a transport element for delivering and removing individual substrate-forming blanks, holding positions for blister strips or the like in which the products are arranged in isolation, each holding position being assigned a separating means for separating the product carriers or the sections from the blister strip, and a mounting head for transporting the product carriers or sections separated from the blister strip from a preparing position to the discharge position on the substrate.

BRIEF DESCRIPTION OF THE DRAWINGS

Further advantageous features and developments of the pack and apparatus as well as further preferred steps of the method are apparent from the subsidiary claims and the description. The pack, the apparatus and the manufacturing method are described in more detail with the aid of the attached drawings. The drawings show:

DETAILED DESCRIPTION

Figure 1:
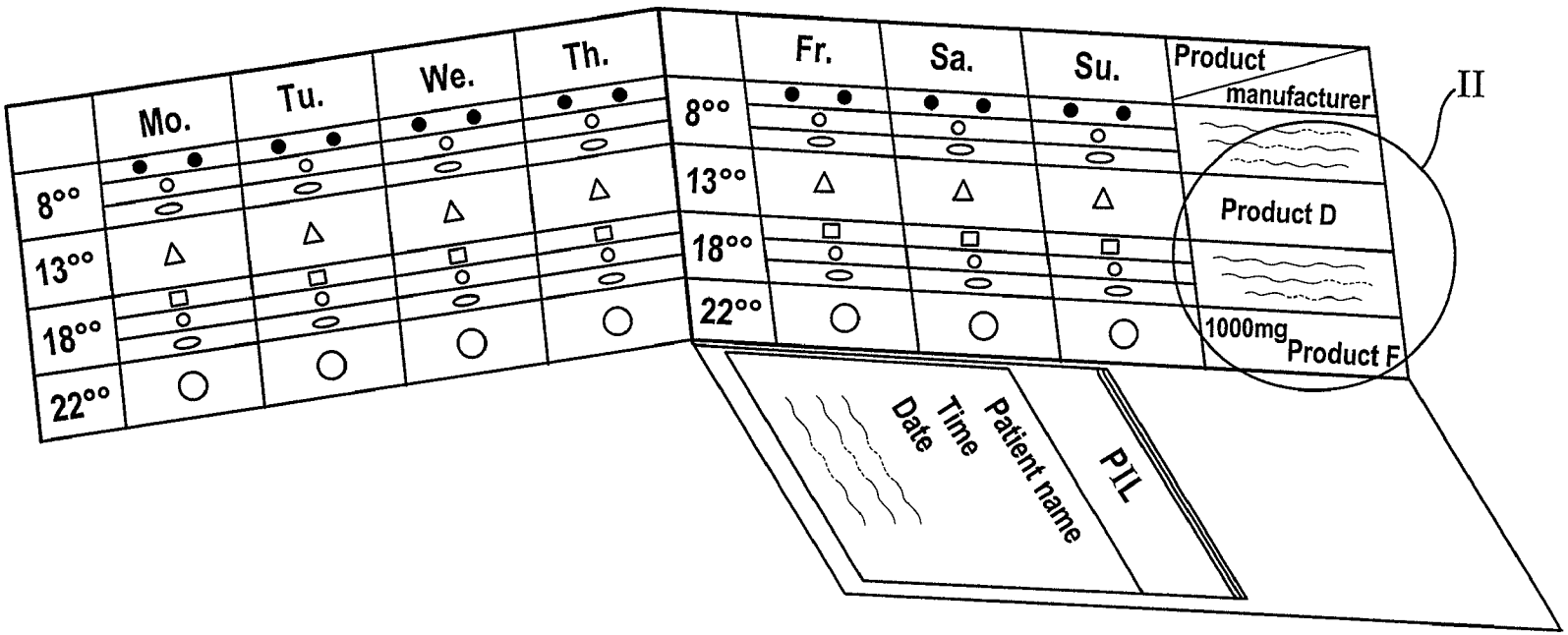
FIG. 1 a schematic view of a pack with patient-specific assembly of the drugs by way of example, FIG. 2 an enlargement of detail II in FIG. 1, FIG. 3 a schematic view of a further pack with patient-specific assembly of the drugs, FIG. 4 a schematic view of a further pack with patient-specific assembly of the drugs, FIG. 5 a schematic view of a further pack with patient-specific assembly of the drugs, FIG. 6 a schematic sectional view of the packs as in FIGS. 1 to 5, and FIG. 7 a schematic view of an apparatus for the manufacture of packs as in FIGS. 1 to 5.
Figure 2:
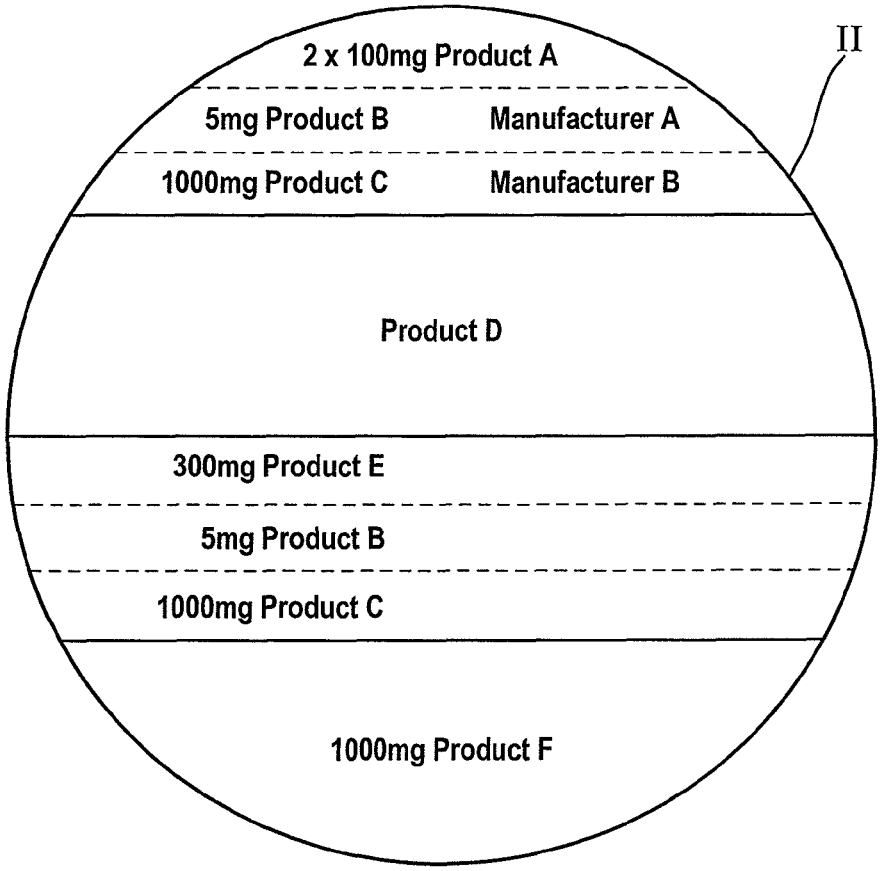
Figure 3:
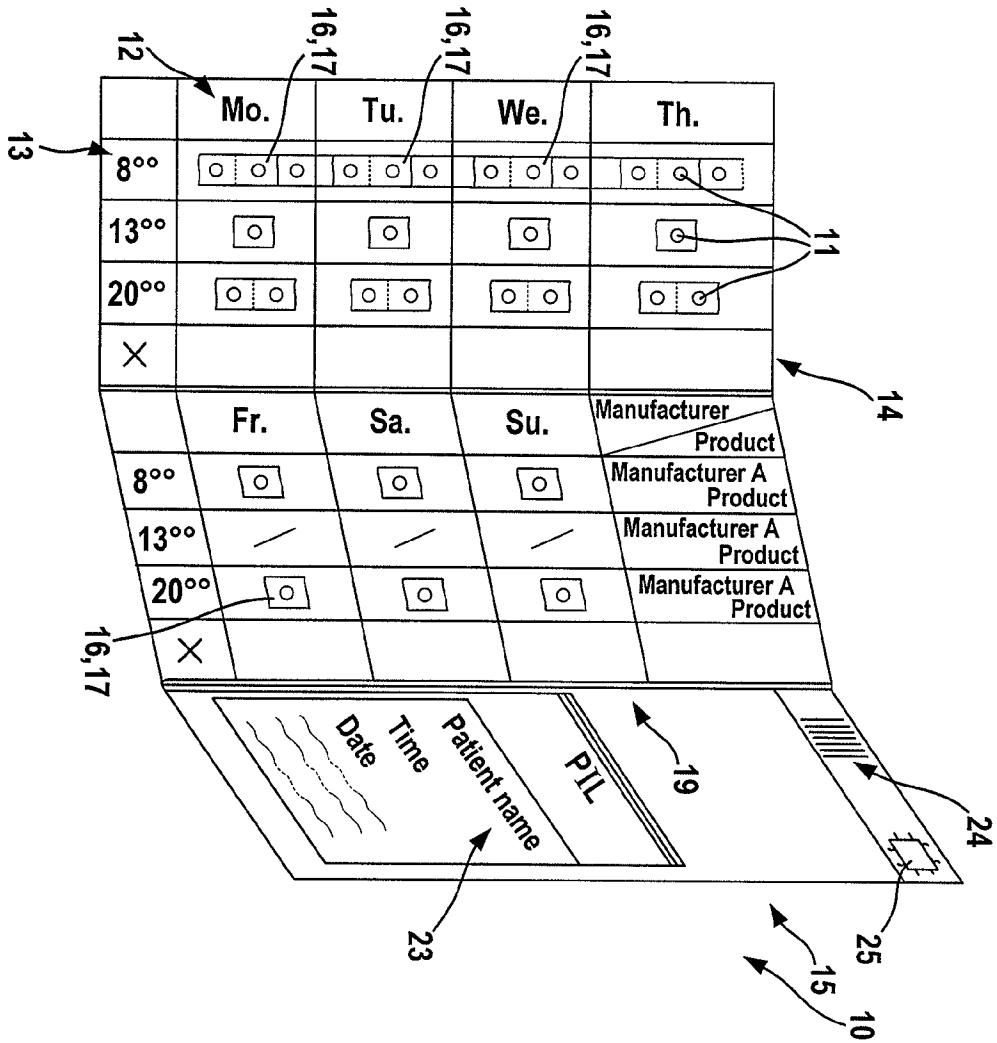
Figure 4:
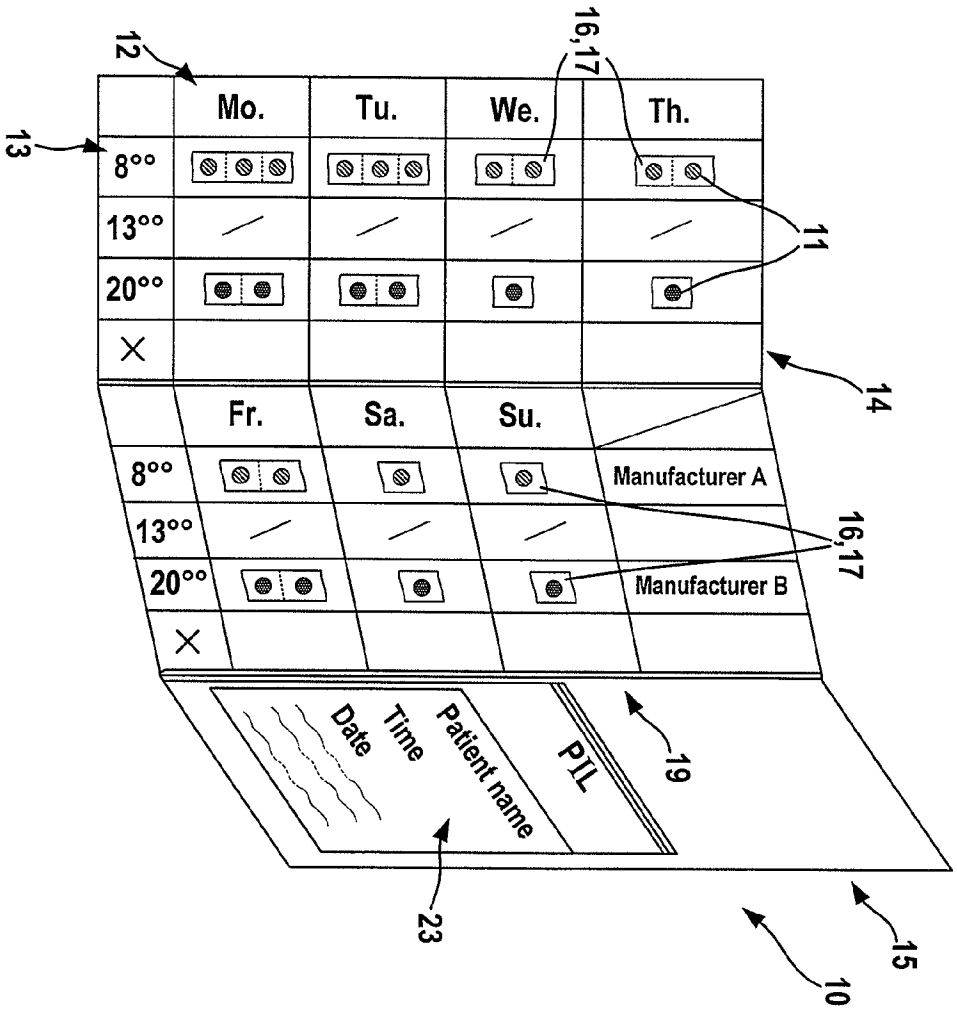

The packs described below are used for patient-specific and individual supply of the patients with pharmaceutical and/or medical products and/or food supplements. In particular, the packs are used for holding tablets, dragées or the like.

Each of the shown packs 10 is provided or mounted with products 11 for a given length of time, whereby the individual treatment particularly for chronically ill patients can stretch over a very long time. In this case the period of time may, as in the embodiments shown, be defined e.g. as a week-by-week calendar 12. But monthly or quarterly divisions may also be provided on the packs 10. In addition to the period of time, the pack 10 has instructions or information 13 on the actual times of application or taking.

The pack 10 includes a substrate 14 which can be made of cardboard, plastic or other suitable materials. The substrate 14 may be flat, that is, free from compartments, or, as in the embodiments, constructed as a folding element 15 for example for forming a so-called wallet pack. The above-mentioned week-by-week calendar 12 or the information 13 is applied to the substrate 14, which preferably exists as a blank, e.g. by printing, stamping or the like. The substrate 14 can have perforations or other weakening of the material in columns and rows respectively in order to simplify separation of individual rows and/or columns in sections.

On the substrate 14 are arranged products 11 subject to prescription and/or subject to pharmacy and/or over-the-counter products 11. These products 11 lie in protected fashion on or within product carriers 16. The product carriers 16 form part of a prefabricated type of pack (not shown explicitly), in particular a blister (strip) pack. The prefabricated product carriers 16 are divided into sections 17 by separation from the blister pack, each section 17 exclusively having products 11 of one type or, to be more precise, a special active ingredient or special combination of active ingredients with a given dose. In other words, each product type is assigned to its own product carrier 16. The product carriers 16 or sections 17 have, in the usual manner for blister packs, so-called nests 18 which are each designed to hold a single product 11. In other words, each nest 18 is assigned only one product 11. Preferably, each product 11 of the product carrier 16 is clearly marked individually with a corresponding optical code. The nests 18 are covered or closed by a film 26 or the like, so that they are completely shielded from the environment. The individual product carriers 16 or the corresponding sections 17 form with the substrate 14 a blister composite 19. Such a blister composite 19 can accordingly have several sections 17 which are separated from a blister strip, in which case the sections 17 can contain the same or different (from different blister strips) products 11 from one or more manufacturers. The sections 17 are arranged in the form of a matrix with columns and rows suitable for administration, with a first section 17 having one or more specimens e.g. of a drug A, each housed in a nest 18 separately from each other, and a second section 17 having one or more specimens e.g. of a drug B, each housed in a nest 18 separately from each other. The number of rows and the number of columns correspond, so to speak, to taking the drugs x times a day, and a period of taking the drugs that extends over y days.

Depending on needs, requirements or prescription, the products 11 are selected individually and with their respective product carriers 16 applied to the substrate 14. In the process the product carriers 16 or the sections 17 are rigidly connected to the substrate 14, for example by hot gluing or the like. Other common fastening options or means e.g. by clamping or the like are, however, also possible. The substrate 14 itself can be used as the pack 10. But the substrate 14 can also be arranged on or in a surrounding package. Preferably the substrate 14 or individual parts of the substrate that carry the product carriers 16 with the products 11 are mounted releasably on the surrounding package, so that if occasion arises they can be delivered to a preferably electronic dispensing device. In other words, the pack 10 can be combined with measures of SF and CR described above.

Figure 6:
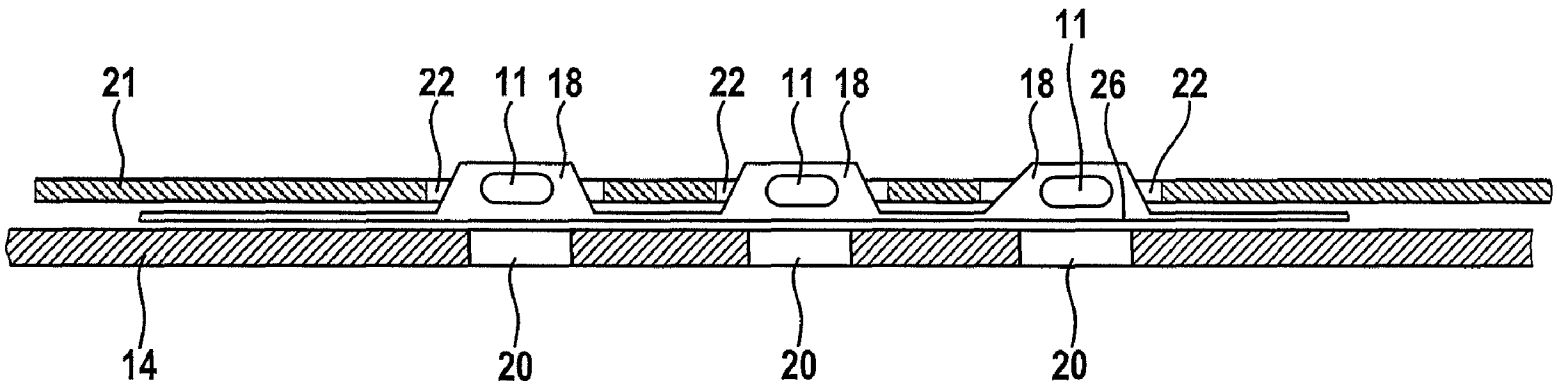

The substrate 14 can have perforated or prestamped areas by which the products 11 can be pressed out of the product carriers 16. As can be seen from FIG. 6, these areas can also be designed as an opening 20. The product carriers 16 or the sections 17 rest on one side (upper side or lower side) on the substrate 14. On the other side the product carriers 16 can be at least partially covered by a covering element 21. In such cases the product carriers 16 lie in sandwich fashion between the covering element 21 and the substrate 14. Here, the covering element 21 also has openings 22 through which the nests 18 with the products 11 extend (see in particular FIG. 6). It is however pointed out that the pack 10 can also be formed just from a substrate 14 with the product carriers 16 mounted thereon or thereunder. In other words, the product carriers 16 can be at least partially covered on one side with cardboard or the like, that is, e.g. the substrate 14, or on both sides with cardboard or the like, that is, e.g. the substrate 14 and the covering element 21. With a covering element 21 of this kind, the product carriers 16 or sections 17 can be additionally fixed and positioned in relation to the substrate 14 as well as in relation to each other.

The pack 10 is assigned further information 23, this information 23 being attached as a patient information leaflet and/or arranged in printed form on the substrate 14 or other surfaces of the pack 10. For example, information about the individual drugs, about the manufacturers or other relevant communications can be removably inserted in a compartment or stuck on the pack 10 as a brochure or booklet. Details of patient data—as an example one might mention here amongst other things a patient photo, date of manufacture of the products 11, doctor giving treatment, pharmacy responsible, health scheme, manufacturing packager, distributor, and other data necessary for unmistakable classification and/or retracing etc. as well as logos and trademarks of the manufacturers and other information—can be printed on the pack 10. The information 12, 13, 23 can be stuck on, printed and/or stamped (e.g. in Braille) or otherwise applied, the positioning of the information 12, 13, 23 preferably being arranged on the side of the substrates 14, the product carriers 16 etc. In addition, for reasons of accounting, a continuous number or the like can be formed on the pack 10. Also data carriers, audio carriers or other media can be attached to the pack 10.

Some of the information, particularly on the contents of the pack 10, for purposes of easy checking/monitoring or for balancing e.g. with the prescription data can also be arranged on the pack 10 in coded form e.g. as a bar code 24 or the like. Basically it is true that all information 12, 13, 23 can be in legible true type and/or as code for example with a luminophore marking. In addition the pack 10 can have an electronic component 25, in particular a memory chip. By means of this component 25, communication with external systems is possible for purposes of monitoring, checking or the like.

The pack 10 described above can be manufactured manually or automatically. The most varied types of package can be formed, for example a pack 10 with one and the same product from one manufacturer, or a pack 10 with different products and/or the same products with different doses of an active ingredient from one manufacturer, or a pack 10 with products from different manufacturers. Any other combinations are possible too. Selected examples are described below.

Figure 5:
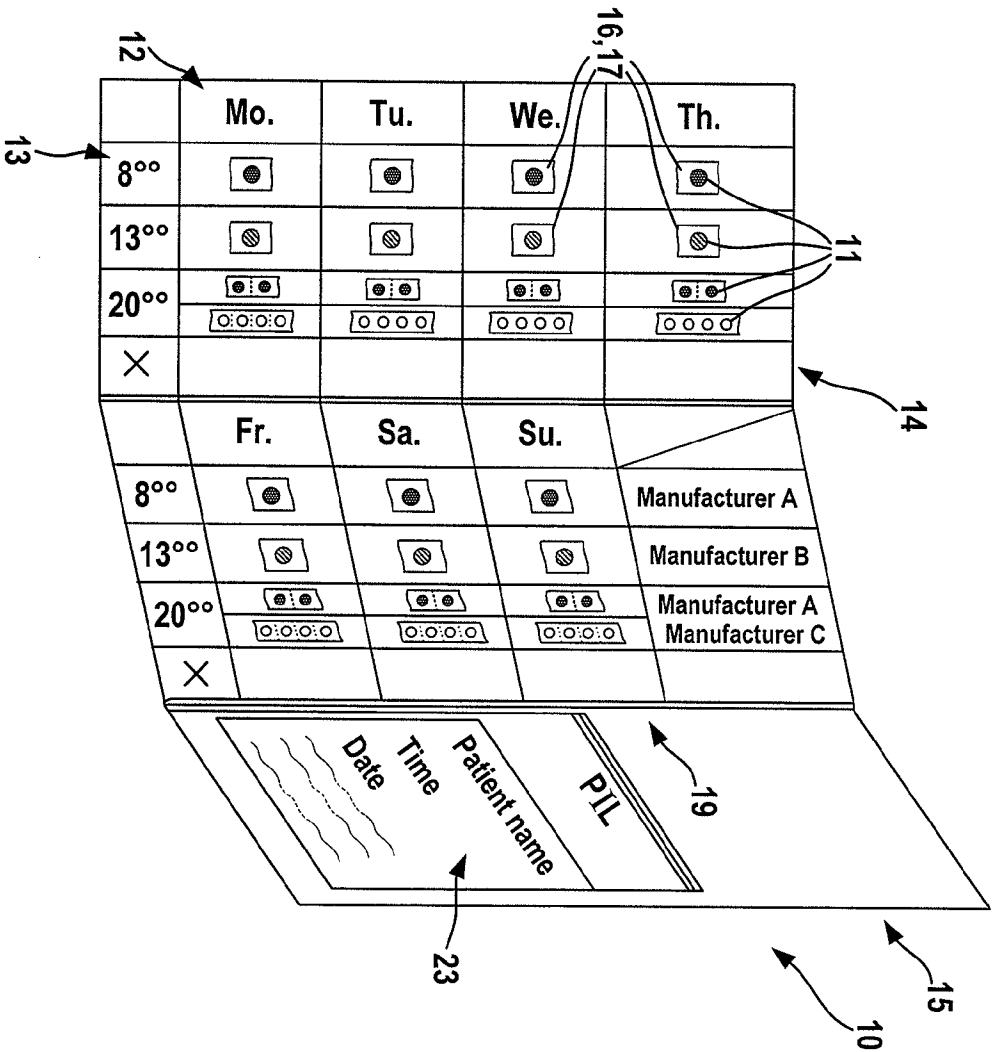

In each of FIGS. 1 to 5 can be seen a pack 10 which contains a "week's ration" for a given patient. Here, in the pack in FIG. 1, which shows for example a possible treatment scheme for ongoing treatment of a chronic illness, six different products (A to F) of different manufacturers in sometimes different dosages are stored by the day. Also the number of products 11 to be taken varies. Besides information on the manufacturer, the pack 10 also carries product instructions (see in particular FIG. 2). In the pack in FIG. 3, all the products 11 which correspond to each other in active ingredient and dosage are from one manufacturer. In addition to the manufacturer's details, alternatively details of the drug itself (name, active ingredient, dosage, etc.) can be provided on the pack 10. It can be seen from the pack 10 in FIG. 3 that besides sections 17 with one or two nests 18 in an area of the matrix can also be provided continuous section strips (e.g. from Monday to Thursday in the 8 a.m. row). In the pack 10 in FIG. 4, two drugs from different manufacturers are assembled. The pack 10 in FIG. 5 provides the patient individually with three different products (drug I from manufacturer A, drug II from manufacturer B and drug III from manufacturer C) from three different manufacturers. In addition a further drug I from manufacturer A with the same active ingredient in a lower dose (to be taken at 8 p.m.) forms part of the pack 10. The manner of assembly is accordingly as desired (freely programmable) and can be supplemented e.g. by additional vitamin preparations, food supplements, etc.

Figure 7:
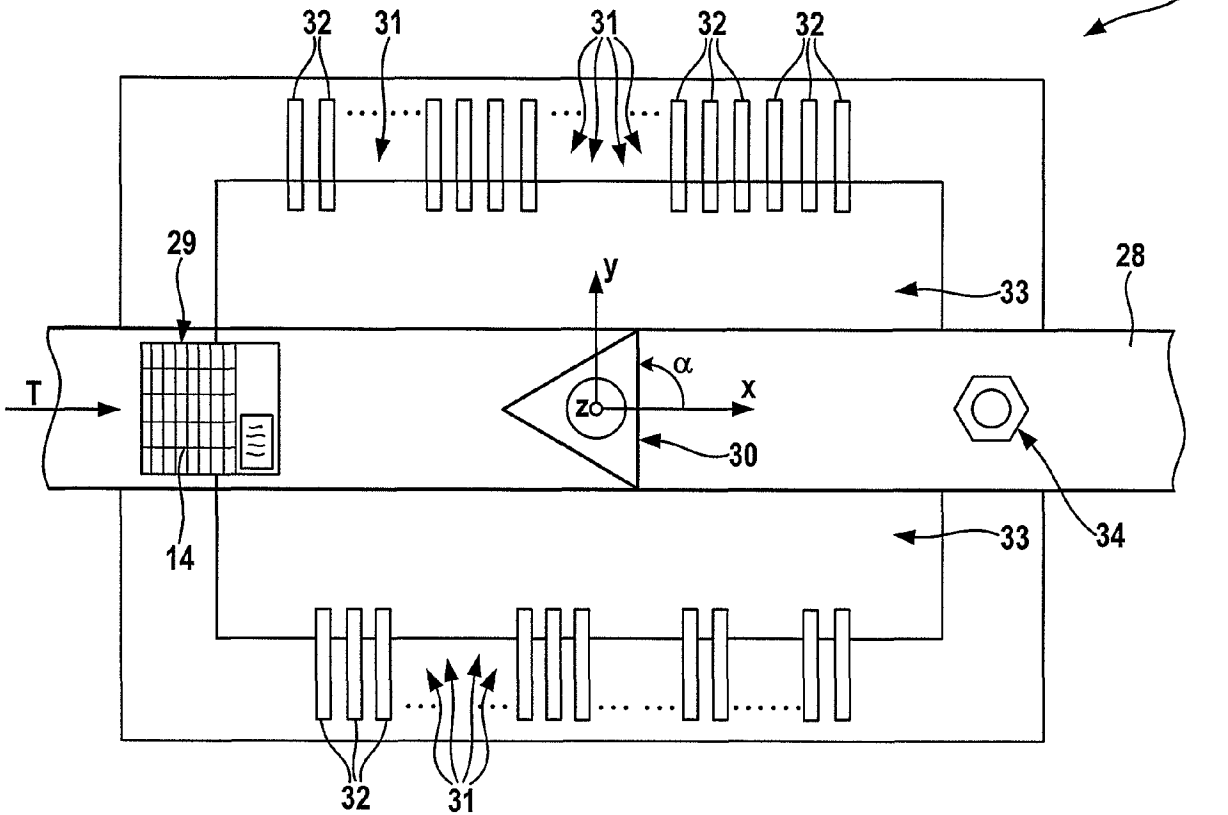

In FIG. 7 is shown by way of example an apparatus 27 for manufacturing the packs 10 described. The apparatus 27 has a transport element 28 for transporting individual blanks 29 which form the substrates 14 through the apparatus 27 and past a mounting head 30. Preferably on both sides of the transport element 28, but also on one side are provided holding positions 31 for rolls 32, magazines or the like, the rolls 32, magazines or the like preferably carrying rolled-up blister strips for the products 11. The mounting head 30 is preferably arranged centrally and serves to transport the product carriers 16 or sections 17 that have been separated from the blister strip from a preparing position 33 to the discharge position on the substrate 14. The apparatus 27 includes for each holding position 31 a separating means by which the product carriers 16 or sections 17 can be separated from the blister strip. In the direction of transport T at the output of the apparatus 27 is mounted a printing station 34 by means of which the information 12, 13, 23 can be applied to the pack. The mounting head 30 has several axes of movement (linear X, Y, Z axes and axis of rotation) and is optionally also movable linearly and/or on a circular path, and has a control means for automatically and individually carrying out the individual manufacturing orders. Preferably the mounting head 30 is connected to an optical reader for checking correct reception of the sections 17 online by means of an optical code on the products 11 or sections 17. For receiving and/or carrying out the orders, the apparatus 27 can be networked and even form part of a network and therefore for example be connected to a logistics system.

Below, the method for manufacturing the packs 10 described above is described in more detail. On the apparatus 27 several rolls 32 are provided with rolled-up blister strips, each blister strip carrying only one type of product (same active ingredient in the same dose), and each individual product 11 being located separately in a nest 18 of the blister strip. A blank 29, for example the substrate 14, is delivered to the apparatus 27. These blanks 29 can be standardised for groups of patients, groups of packs (one-week pack, one-month pack, etc.) and may be blank or preprinted (e.g. with week-by-week calendar, time scale or the like). An order for manufacturing a pack 10 is given to the apparatus 27 manually or automatically, the order containing the patient-specific data (what drug, what quantity, etc.). As soon as the data are loaded, the order is processed by selecting the products 11 (of one or more manufacturers and/or one or more dosages, etc.) and cutting them off or otherwise separating them from the rolls 32 or the prefabricated product carriers 16. The product carriers 16 or sections 17 which have been separated from the strip are then conveyed to the preparing position 33 and there taken up by the mounting head 30, which is movable over several axes (e.g. X, Y, Z axes) and delivered to the substrate 14. Beforehand the substrate 14 can have been provided with gluing points or the like, the positions of the gluing points being shown by the arrangement of the sections 17 to be fitted on the substrate 14. The sections 17 are applied to the gluing points so that a firm bond is made between the sections 17 and the substrate 14. Other connecting techniques are possible too. After complete fitting of the substrate 14, correct fitting and placement of each section 17 is checked by optical methods and then the covering element 21 is applied, which as a flap element forms part of the blank 29 or is delivered separately. The blister composite 19 formed by the substrate 14 fitted with several sections 17 is then delivered to the printing station 34 and given the desired information. Next the pack 10 is prepared ready for dispatch. The blister strip packs or the like to be divided into sections 17 can also be stocked and processed on the apparatus 27 in unrolled, folded, unfolded or other form of presentation.

Optionally, additional monitoring and/or security steps can be taken, e.g. by reading manufacturing or patient data or other information into the memory chip 25. Using the code 24, further checking or security steps can be performed. As described, manufacture of the packs 10 is usually automatic. In this case, order data (such as e.g. a prescription) can be delivered directly to the apparatus 27 and converted by the latter. Usually the method is carried out with computer assistance.

Abstractly, the method can also be described as follows. To supply patients with requirements of a drug A and/or a drug B assembled individually for the patients for a given period of time for taking the drugs, it is proposed to provide drug A in a vehicle C carrying a plurality of separately housed and spaced-apart specimens EA of drug A and/or drug B in a vehicle D carrying a plurality of separately housed and spaced-apart specimens EB of drug B, to separate from vehicle C sections CA with one or more specimens EA of drug A and/or from vehicle D sections DB with one or more specimens of drug B, and to arrange the separated sections CA and/or DB in a matrix-like formation on a substrate suitable for taking.

With the type of pack described above as well as the method and the apparatus for manufacture of the pack, a particularly efficient and cheap method for the distribution of pharmaceutical and/or medical products 11 or packs 10 can be carried out, which is described in more detail below. Concretely, the method by the example of tablets proceeds e.g. as follows. A distribution centre manufactures patient-specific packs. A client delivers the information necessary for assembling the pack. The information may be conveyed verbally, in writing or usually in electronic form. Patients can themselves act as the client as long as it is a question of over-the-counter products/tablets not subject to dispensary. But as a rule the information contains prescription data which are drawn up by a doctor and conveyed by the latter or by a pharmacy direct to the distribution centre.

The tablets required for assembling the desired pack which is individual in content and quantity can be delivered to the distribution centre direct from different manufacturers. In the event that the tablets are supplied as raw materials to the distribution centre, the distribution centre itself puts the tablets in blister strips, so that the tablets are available for further processing in prefabricated blister strips. In this case each blister strip is assigned only one product of a special active ingredient or special combination of active ingredients with a special dosage. On the blister strip itself, each nest of the blister strip is assigned only one tablet. From these prefabricated blister strips the individual pack 10 is then assembled. In the usual event that the tablets are put in blister strips directly by the actual producer of the tablets, the manufacturers supply the blister strips to the distribution centre.

Depending on the area of collection or supply, the distribution centre is organised regionally. This means that the distribution centre ensures assembly and delivery of the individual packs in a locally defined surrounding area. As a rule there are several regional distribution centres which can be supplied direct by the manufacturers. A supraregional, national or international distribution centre may however also be provided. The higher distribution centre receives the tablets from one or more manufacturers in turn as raw materials and/or packed in blister strips. The blister strips and the blister strips filled with the raw materials by the distribution centre are then either supplied direct to one or more regional distribution centres and/or to a logistics unit, in which case the logistics unit may also be divided into several smaller units.

Independently of delivery to the distribution centre producing the packs 10, the distribution centre has stockpiled the commonest and most frequently prescribed products 11 as well as the most widespread combination preparations. This means that, on the basis of incoming information and figures based on experience, the preparations which are needed to assemble individual packs 10 are provided. Even if individual products 11 are not in stock at the distribution centre, these products 11 can be procured at short notice from the manufacturer and/or from the higher distribution centre and/or from the logistics unit.

The clients can be networked to the distribution centre for the transfer of orders. But the transfer of information can also take place conventionally by e-mail or in some other normal computer-assisted manner. The incoming orders can be processed automatically and under computer control within the distribution centre using suitable apparatuses 27 by separating the selected products 11 in a predetermined quantity from the blister strips stocked and depositing them on a blank, substrate 14 or the like delivered to the apparatus 27. The patient-individual blister composites or packs 10 produced as a result can then be further inscribed, coded or otherwise marked and checked before delivery, in particular using electronic aids as well.

In addition, the distribution centre is optionally connected to the logistics unit and/or the higher distribution centre and/or the manufacturers. This connection can be made by traditional means of communication or ensured by networking. Also, several distribution centres may be networked to each other. Due to the links, in particular products 11 or blister strips can be supplied to the or each distribution centre manufacturing the packs 10, controlled by need and/or controlled by order. Also stocking with the relevant products 11 or blister strips within the stations is easy to ensure.

The packs 10 produced can be supplied by the distribution centre itself or by the logistics unit, as it were, as a courier service to the client, for example a pharmacy, or direct to the patient.

The invention claimed is:

1. A pack for at least one of pharmaceutical, medical products and food supplements, comprising:

a plurality of sections comprising one or more prefabricated sealed product carriers that each contain one or more isolated products of a special active ingredient or a special combination of active ingredients in a special dosage for a patient's use over a given period of time, wherein each of the plurality of sections is dispensed and separated from a rolled-up single-strip blister pack;

a substrate which mounts the plurality of sections and is provided with instructions for application or administration time for the patient, wherein each said prefabricated sealed product carrier contains the one or more isolated products to be administered individually to the patient, wherein the substrate and the plurality of sections comprise a blister composite, and wherein the plurality of sections each includes an optical code, each optical code identifying different isolated products of an active ingredient or combination of active ingredients from one or more manufacturers that are applied to the substrate; and a separate covering element adapted to be coupled to the substrate, wherein the one or more prefabricated sealed product carriers are arranged between the substrate and the covering element.

2. The pack according to claim 1, wherein each rolled-up single-strip blister pack or each section of the rolled-up single-strip blister pack includes a nest in which is arranged precisely one product.

3. The pack according to claim 1, wherein the plurality of sections are rigidly connected to the substrate.

4. The pack according to claim 3, wherein the plurality of sections are glued to the substrate.

5. The pack according to claim 1, wherein the substrate or the one or more prefabricated sealed product carriers include information on days of the week and a time for taking or applying the products.

6. The pack according to claim 1, wherein the substrate includes information on at least one of the patient, the product and a manufacturer of the pack or the product.

7. The pack according to claim 6, wherein the information is shown as legible true type and/or as code on the substrate.

8. The pack according to claim 1, further comprising an electronic component that is assigned to the substrate and that is adapted for the storage of data and/or information.

9. The pack according to claim 1, wherein the pack is manufactured fully automatically.

10. The pack according to claim 1, wherein the substrate includes perforated areas from which the isolated products are pushed out of the one or more prefabricated sealed product carriers.

11. The pack according to claim 10, further comprising continuous section strips that contain a plurality of isolated products for a plurality of days of the week.

12. The pack according to claim 11, wherein the one or more prefabricate sealed product carriers are adapted to display information about the isolated product itself.

13. A method for the manufacture of a pack for at least one of pharmaceutical, medical products and food supplements, comprising the following steps:

dispensing and separating a plurality of sections from a rolled-up single-strip blister pack, the plurality of sections comprising one or more prefabricated sealed product carriers that each contain one or more isolated products of a special active ingredient or a special combination of active ingredients in a special dosage for a patient's use over a given period of time;

mounting the plurality of sections on a substrate, wherein the substrate is provided with instructions for application or administration time for the patient, wherein each said prefabricated sealed product carrier contains the one or more isolated products to be administered individually to the patient, wherein the substrate and the plurality of sections comprise a blister composite, and wherein the plurality of sections each includes an optical code, each optical code identifying different isolated products of an active ingredient or combination of active ingredients from one or more manufacturers that are applied to the substrate; and coupling a separate covering element to the substrate, wherein the one or more prefabricated sealed product carriers are arranged between the substrate and the covering element.

14. The method according to claim 13, further comprising gluing the one or more prefabricated, sealed product carriers to the substrate.

15. The method according to claim 13, further comprising marking the substrate or the one or more prefabricated, sealed product carriers with information on at least one of days of the week, time of taking or application.

16. The method according to claim 13, further comprising printing information on the substrate regarding at least one of the patient, the patient-individual product or the manufacturer.

17. The method according to claim 13, further comprising reading the manufacturing and/or product information into an electronic component of the substrate.

18. The method according to claim 13, further comprising selecting the isolated products with reference to a prescription.

19. The method according to claim 13, further comprising manufacturing the pack automatically.

20. The method according to claim 13, further comprising carrying out the method with computer assistance.

21. The method according to claim 19, further comprising transmitting one of the information specific to the patient with the selected patient-individual products directly from one of a doctor, a pharmacy, a hospital and other authorised persons online to an apparatus for assembling the pack.

22. The method according to claim 13, further comprising mounting the plurality of sections on the substrate according to information specific to the patient.

23. The method according to claim 13, further comprising checking a correct fitting and placement of each of the plurality of sections by an optical method.

24. An apparatus for the manufacture of a pack for at least one of pharmaceutical, medical products and food supplements, comprising:

a transport element to deliver a substrate and to remove portions of the substrate to form blank holding positions for rolled-up single-strip blister packs or the like in which a plurality of products are arranged in isolation and sealed;

a separating element adapted to separate a plurality of sections from the rolled-up single-strip blister packs, the plurality of sections comprising one or more prefabricated sealed product carriers that each contain one or more isolated products of a special active ingredient or a special combination of active ingredients in a special dosage for a patient's use over a given period of time;

a mounting head to transport the plurality of sections separated from the rolled-up single-strip blister pack from a preparing position to a discharge position on the substrate, wherein the plurality of sections are mounted on the substrate in the discharge position, wherein the substrate is provided with instructions for application or administration time for the patient, wherein each said prefabricated sealed product carrier contains the one or more isolated products to be administered individually to the patient, wherein the substrate and the plurality of sections comprise a blister composite, and wherein the plurality of sections each includes an optical code, each optical code identifying different isolated products of an active ingredient or combination of active ingredients from one or more manufacturers that are applied to the substrate; and a device adapted to couple a separate covering element to the substrate, wherein the one or more prefabricated sealed product carriers are arranged between the substrate and the covering element.

25. The apparatus of claim 24, wherein the separating element is assigned to each holding position to separate the plurality of sections from the rolled-up single-strip blister pack.

* * * * *